United States Patent [19]

Schippers et al.

[11] 4,326,677

[45] Apr. 27, 1982

[54] MONITORING CIRCUIT FOR HIGH SPEED SPINDLE ASSEMBLY

[75] Inventors: Heinz Schippers, Remscheid; Bernd Schimmels, Radevormwald; Dieter Salm, Dhünn, all of Fed. Rep. of Germany

[73] Assignee: Barmag Barmer Maschinenfabrik, Remscheid, Fed. Rep. of Germany

[21] Appl. No.: 182,622

[22] Filed: Aug. 29, 1980

[30] Foreign Application Priority Data

Aug. 31, 1979 [DE] Fed. Rep. of Germany ..... 2935218
Oct. 6, 1979 [DE] Fed. Rep. of Germany ..... 2940612

[51] Int. Cl.[3] ..... B65H 54/42; B65H 63/00

[52] U.S. Cl. ..... 242/18 DD; 242/18 R; 242/36; 242/46.2; 242/49; 340/682

[58] Field of Search ..... 242/18 DD, 18 R, 36, 242/28, 49, 57, 46.2–46.6; 340/682, 683

[56] References Cited

U.S. PATENT DOCUMENTS 3,042,324 7/1962 Kinney ..... 242/18 DD
3,176,286 3/1965 Dschen ..... 340/682
3,508,241 4/1970 Potter ..... 340/682
3,917,182 11/1975 Lenk ..... 242/18 DD X

*Primary Examiner*—Stanley N. Gilreath

[57] ABSTRACT

A high speed textile spindle assembly is provided which includes a spindle adapted to support a yarn package, a spindle support housing, and bearing means rotatably mounting the spindle on the support housing and including a relatively elastic, electrically nonconductive member, and such that the spindle is adapted to be operated at a rotational speed above its critical speed to thereby avoid vibrational resonant conditions. A monitoring circuit is provided for detecting metal to metal contact between the spindle and support housing, which would be indicative of a failure of the elastic member, and which could result in operation at its critical speed and damage to the assembly from the resulting excessive vibrations. Upon the detection of such contact, the monitoring circuit initiates a responsive electrical signal, which preferably terminates rotation of the spindle. The monitoring circuit also includes provision for monitoring its own proper functioning.

8 Claims, 4 Drawing Figures

MONITORING CIRCUIT FOR HIGH SPEED SPINDLE ASSEMBLY

The present invention relates to a high speed textile spindle assembly having provision for avoiding operation at a rotational speed coinciding with the critical speed of the spindle and where harmful vibrations may occur.

As is known, rotatable spindles as used for example in the textile industry have a natural frequency, at which vibrational resonance occurs, and which depends on the mass and elastic flexibility of the spindle. When a spindle is driven at an operating speed which corresponds to its natural frequency, which is referred to as its "critical speed", the vibrations of the spindle are amplified, which may lead to the damage of the spindle or its mounting structure.

To avoid operation at the so-called critical speed, the spindles are commonly very rigidly mounted. This results in limited elastic flexibility of the spindle, and thus also in a high natural frequency and a high critical speed. Such a bearing mount is used when the operating speed range is relatively low. If the operating speed range is high, the spindle and the bearing mount may be so designed to resiliently support the spindle to thereby permit greater elastic flexibility, which in turn results in a relatively low natural frequency and critical speed. In this instance, the spindle passes the critical speed during the initial start-up period in such a short time that a dangerous build-up of vibrations does not occur, and in operation the spindle runs above the critical speed, i.e., at a "supracritical" speed. A support mounting of this type is described herein as a "supracritical" bearing mount.

A supracritical bearing mount may be obtained by supporting the spindle in its support housing with interposed elements having a low modulus of elasticity. These may, for example, comprise rubber elements, or elements made of other materials having similar elastic characteristics. Such bearing mounts are typically utilized for the spindles of the yarn take-up packages on synthetic yarn processing machines, which operate at speeds of more than about 3,000 m/minute.

In the event of a faulty assembly, or damage or wear of the elastic elements, the spindle or the antifriction bearings in which the spindle is supported, may come into metallic contact with the stationary support housing during operation of the spindle. In addition, excessive external forces may lead to such an internal metallic contact. Any metallic contact between the spindle and housing however is dangerous since, as far as the elasticity and natural frequency are concerned, that the critical speed is shifted to ranges which possibly correspond with the operating speed.

It is accordingly an object of the present invention to avoid the above disadvantages of the prior supracritical bearing mount.

It is a more particular object of the present invention to provide a high speed textile spindle assembly having provision for generating a control or warning signal which avoids operation of the spindle at its critical speed frequency wherein harmful vibrations may occur.

These and other objects and advantages of the present invention are achieved in the illustrated embodiments of the invention by the provision of a high speed textile spindle assembly comprising a spindle adapted for supporting a yarn package thereon, a spindle support housing, bearing means rotatably mounting the spindle on the support housing and including a relatively low modulus elastic, electrically non-conductive insert means interposed between the spindle and support housing, and means for rotatably driving the spindle. In accordance with the present invention, there is further provided an electric monitoring circuit which is operatively connected to both the spindle and support housing for detecting contact therebetween in the event of undue wear or failure of the insert means, and for generating a responsive signal upon such contact being detected. This response may consist of lighting a signal lamp. Preferably however the response includes simultaneously terminating rotation of the spindle, since, if a critical speed occurs for a few seconds, the vibrations may build up and lead to the destruction of the spindle or its supporting structure.

The electrical connection between spindle and the stationary bearing housing may be established by means known per se, such as sliding brushes or inductive or capacitive, non-contacting transmission elements. The advantage of sliding brushes lies in their ruggedness.

An advantage of the present invention includes the fact that, as soon as a metallic contact is made between the shaft, antifriction bearings and bearing housing, a signal is generated, which as a warning signal leads either to the disconnection of the spindle or, preferably, immediately to the disconnection of the spindle drive.

In a preferred embodiment, two sliding brushes are present and incorporated in the monitoring circuit, and they serve to monitor for interrupted lines. Should one of these contact brushes fail, a signal is produced by the interrupted line monitoring system of the circuit, to initiate a responsive signal according to the invention.

Some of the objects having been stated, other objects will appear as the description proceeds, when taken in connection with the accompanying drawings in which.

Figure 1:
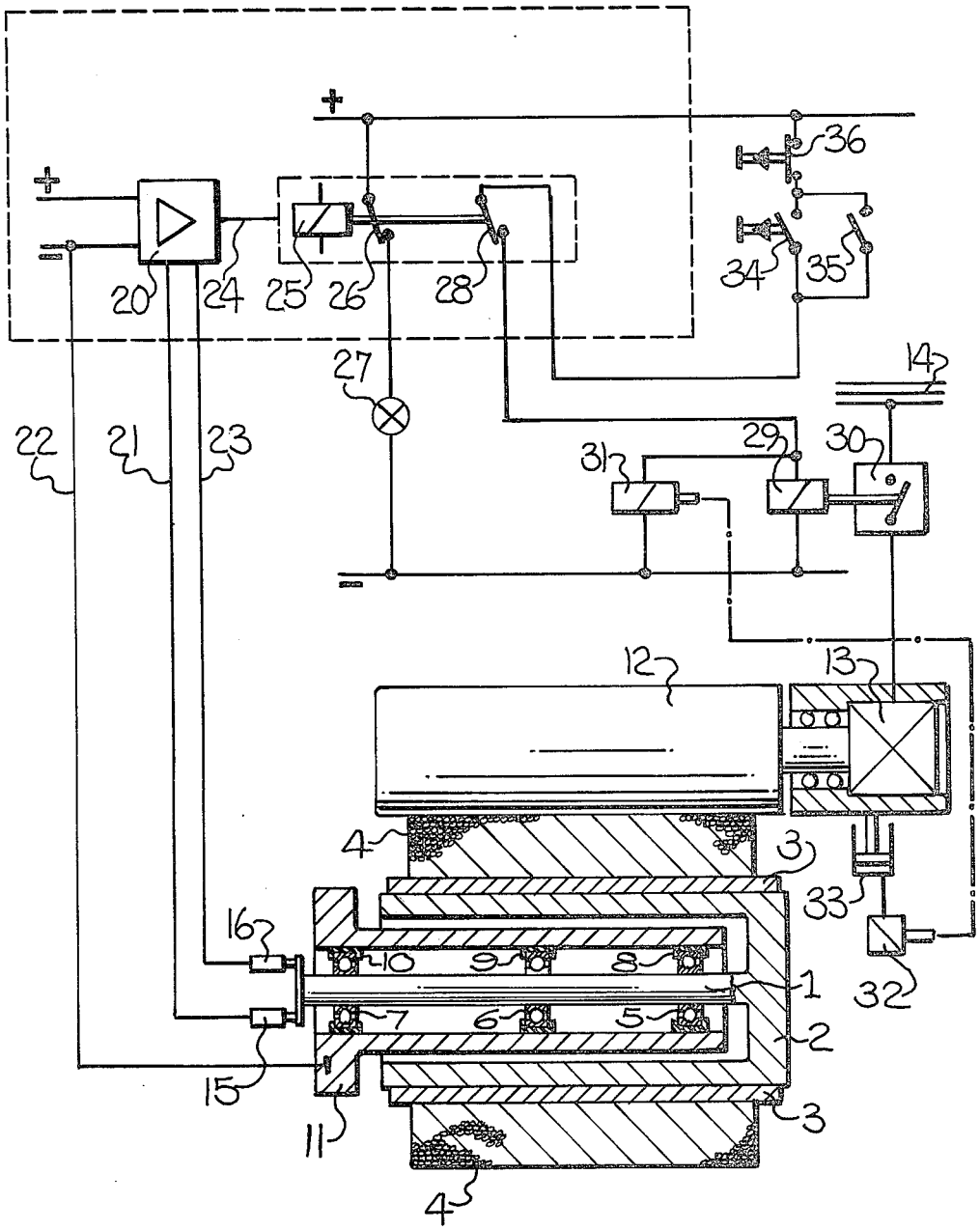
FIG. 1 is a schematic view of a winding spindle for textile yarns or filaments, and which includes a monitoring circuit according to the present invention.

Referring more specifically to the drawings, there is illustrated in FIG. 1 winding spindle 1 of the type commonly used in take-up machines for synthetic yarns. Such synthetic yarns are produced at drawoff speeds of 3,000 m/min. and more, and must be wound on a package 4 at this speed. In doing so, the package must have a constant circumferential speed, since otherwise, the quality of the synthetic yarn may fluctuate along the yarn length. On the other hand, it is desirable to produce the most voluminous packages possible. This means that at the beginning of the winding process, the speed of the winding spindle is very high, and it decreases with increasing package diameter. Further, it is usually preferred to mount such winding spindles resiliently, i.e. supracritically, so that they pass the critical speed during initial start-up.

The exemplified embodiment according to FIG. 1 illustrates a metal winding spindle 1, which is rotatably mounted in antifriction bearings 5, 6, 7 located in metal bearing support housing 11, which is constructed as a sleeve disposed coaxially about the spindle. Rubber elements 8, 9, 10 are interposed between the antifriction bearings and the interior of the tubular bearing sleeve or housing 11. The bearing housing is stationary. Firmly connected to the winding spindle is chuck 2, which concentrically surrounds the stationary, tube-shaped bearing housing 11. Chuck 2 supports a hollow winding tube 3 on which a yarn package 4 is wound. The winding spindle is driven by drive roll 12 resting on the circumferece of package 4, which is driven by motor 13 at a constant circumferential speed. This means that at the beginning of the winding cycle, i.e. when no yarn has been deposited on tube 3, the winding spindle operates at a higher speed than in the shown or later phase of the winding process.

Drive roll 12 can be moved in the radial direction with respect to the winding spindle 1 and the package 4, so that the drive roll 12 can accommodate the increasing diameter of the package. The schematically illustrated lifting mechanism (pneumatic cylinder-piston assembly 33) removes drive roll 12 from the package circumference, when the winding process has been completed or is to be terminated.

It should be noted that the present invention is also applicable to winding mechanisms in which the drive roll is mounted for rotation about a fixed axis, and the bearing housing of the winding spindle is movable in such a manner that the winding spindle can accommodate the increasing winding diameter.

At its free end, the winding spindle supports a pair of sliding carbon brushes 15, 16 which are connected to an amplifier 20 through lines 21, 23 respectively. Stationary bearing housing 11 is connected via line 22 to the source of voltage which also supplies amplifier 20. Although it is not shown in FIG. 1, amplifier 20 also contains a circuit which is adapted to monitor interruptions of lines 21, 23 and sliding brushes 15, 16.

As further described below, an output signal 24 is produced by the amplifier 20 when an electric current flows in the circuit consisting of lines 21, 23 sliding brushes 15, 16 and winding spindle 1, and to the stationary bearing housing 11 and line 22. This occurs when the insulating rubber elements 8, 9, 10 are improperly installed, slip, or wear due to operation, or a metallic contact develops between the outer race of the antifriction bearings 5, 6, 7 and the stationary bearing housing 11 due to metallic impurities.

The output signal 24 emitted from amplifier 20 may be used to produce an optical or acoustical signal. In the exemplified version however, the output signal is used as follows: Normally, the drive roll motor 13 is started by circuit closer 34 and holding contact 35 through relay 29 and switch 30, with the switch 30 connecting the motor 13 to a three-phase electric circuit 14. At the same time when circuit closer 34 is actuated, relay 31 energizes and actuates its mechanical output signal converter 32, which operates the pneumatic cylinder-piston assembly 33 in such a manner that drive roll 12 is moved downwardly, i.e. toward package 4. When output signal 24 appears, the relay 25 opens switch 28, which deenergizes relays 29 and 31 and, thus the holding contact 35 and switch 30 open. Furthermore, converter 32 is actuated in such a manner that the pneumatic cylinder-piston assembly lifts drive roll 12 from the package. Also, at this point a brake (not shown) may be operated to stop the rotation of the spindle.

Control lamp 27 constantly monitors the operating condition of the safety apparatus. With the emission of output signal 24, switch 26 disconnects the control lamp, to thereby result in an optical signal being also given.

Figure 2:
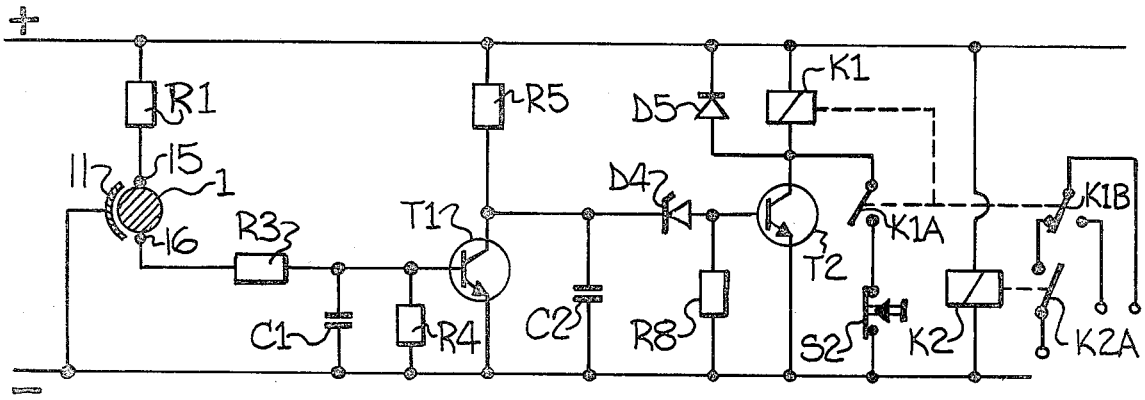
FIGS. 2 through 4 are schematic diagrams of various specific monitoring circuits suitable for use with the present invention.

According to the specific wiring diagrams illustrated in FIG. 2, the operation is monitored as follows:

1. Normal operation:

As seen in FIG. 2, a positive voltage is supplied to the base of transistor T1 via resistor R1, carbon brushes 15 and 16, as well as shaft 1. Thereby, transistor T1 becomes conductive, and the voltage between collector and emitter of transistor T1, and, thus across the charging capacitor C2, is very small. Zener diode D4 is closed. Also, transistor T2 is closed by reason of the leakage resistor R8. Therefore, relay K1 is not energized. Capacitor C1 is used to blead off short interfering signals. Resistor R4 is the leakage resistor for transistor T1.

2. Contact between shaft 1 and housing 11:

Should, in the event of trouble, contact be made between shaft 1 and housing 11, the shaft 1 becomes directly connected, i.e, with very little resistance, to the negative pole of the source of voltage during the period of contact. Thus, the base of transistor T1 is connected to the negative pole through resistor R3. Transistor T1 is thereby closed. This allows capacitor C2 to become charged through resistor R5 at the time constant $T=C2\times R5$. As soon as the voltage on C2 exceeds the Zener voltage of diode D4, transistor T2 becomes conductive. Relay K1 then energizes and holds through its contact K1A. Furthermore, another contact K1B of relay K1 is concurrently actuated, which then effects the entire control of the termination of rotation of the spindle in the manner described above. By pushing button S2, the locking effect of relay K1 is released and the system is again brought back to its monitoring condition. Diode D5 is used to avoid high voltage peaks when relay K1 is disconnected.

3. Open circuit monitoring through the carbon brushes:

When the line via the carbon brushes 15, 16 is interrupted, a positive voltage is no longer supplied to the base of transistor T1. The base of transistor T1 is thus connected to the negative potential through leakage resistor R4, and the transistor closes. Thus, the same effect results as when contact is present between shaft 1 and housing 11 as described above.

Figure 3:
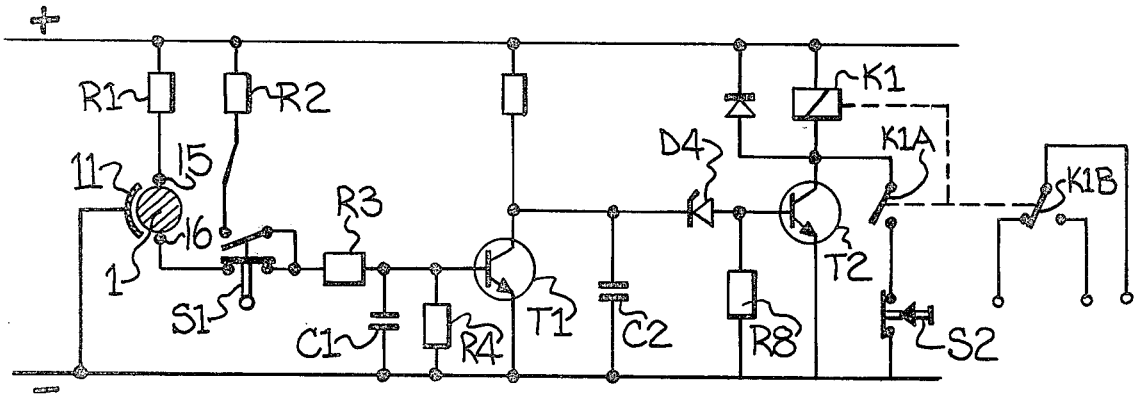

4. Disconnecting the system for example during the start-up of the spindle:

As shown in the embodiment of FIG. 3, the line for the positive voltage leading to shaft 1 via the carbon brushes 15, 16 is interrupted when the switch S1 is actuated, and the positive voltage is instead directly connected to the base of transistor T1 via resistors R2 and R3. Thus when the switch is actuated, which may be done for example during start-up, a contact between shaft 1 and housing 11 has no effect.

Figure 4:
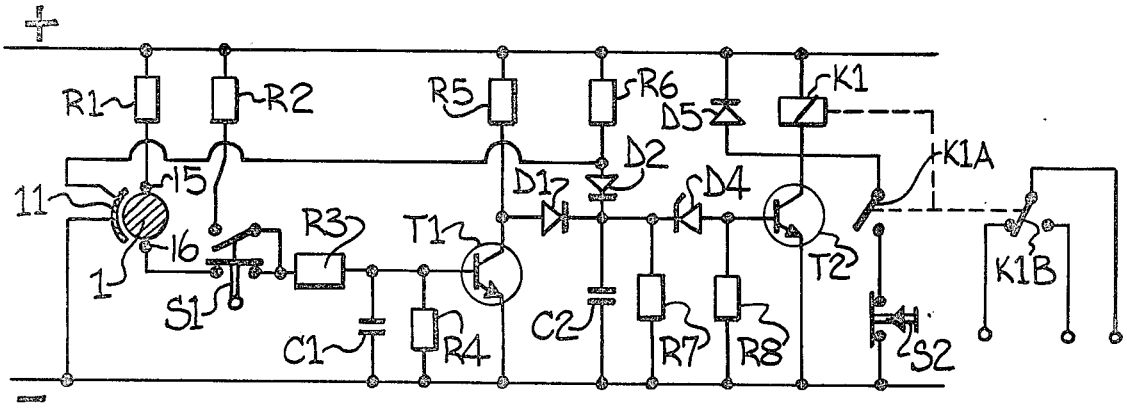

5. Housing 11 is not connected to the negative pole of the source of voltage:

According to the embodiment of FIG. 4, provision is made for monitoring whether the negative pole of the source of voltage is connected to housing 11. Normally, an electric current flows from the positive source of voltage through resistor R6 to housing 11 connected to negative potential. In this case, the connection point between diode D2 and resistor R6 has a very low potential. Since transistor T1 is also conductive, the collector of transistor T1 and thus the connection point between resistor R5 and diode D1 also have a low potential. Thus, diode D2 is closed. Capacitor C2 discharges via resistor R7. When the connection between the negative pole of the source of voltage and housing 11 is interrupted, electric current can no longer flow through housing 11. Thus, diode D2 becomes conductive. Capacitor C2 charges, irrespective of the state of transistor T1, through resistor R6 and diode D2. When the voltage on capacitor C2 exceeds the Zener voltage of Zener diode D4, transistor T2 becomes conductive, and relay K1 energizes and holds. Therefore, both diodes D1 and D2 are used for reciprocal decoupling of the voltages. The circuit system may also operate according to the closed circuit current principle by adding a reversal stage. Thereby, it is possible to also disconnect the spindle, when no supply voltage is present for the monitoring system. The reversal stage is represented in FIG. 2 by relay K2 operable to open its switch K2A if no supply voltage is present.

In the drawings and specification, there has been set forth a preferred embodiment of the invention, and although specific terms are employed, they are used in a generic and descriptive sense only and not for purposes of limitation.

What is claimed is:

1. In a high speed spindle assembly adapted for operation at a supracritical speed and having a spindle adapted to support a yarn package, spindle support means, bearing means rotatably mounting the spindle on the spindle support means and including relatively low modulus elastic, electrically non-conductive insert means interposed between the spindle and spindle support means, and means for rotatably driving the spindle, the improvement therewith of electric circuit monitoring means operatively connected to each of said spindle and spindle support means for detecting contact between said spindle and spindle support means in the event of undue wear or failure of said insert means interposed therebetween and for generating an electric signal upon such contact being detected.

2. In a high speed textile spindle assembly as defined in claim 1 wherein said electric circuit monitoring means includes means responsive to said electric signal for terminating rotation of said spindle.

3. In a high speed textile spindle assembly as defined in claim 1 wherein said electric circuit monitoring means includes a pair of brushes mounted for slideable contact with said spindle during rotation thereof.

4. In a high speed textile spindle assembly as defined in claim 3 wherein said electric circuit monitoring means further includes a transistor, and with the base of said transistor being connected to a voltage source via a line which includes said brushes and spindle to maintain the transistor conductive during normal operation of the spindle, and such that the opening of said line acts to render said transistor nonconductive to thereby initiate said electric signal.

5. In a high speed textile spindle assembly as defined in claim 2 wherein said electric circuit monitoring means further comprises means for selectively disconnecting the operation of said circuit to permit the continued rotation of said spindle during start-up or the like and despite such contact being detected.

6. In a high speed textile spindle assembly as defined in claim 2 wherein said electric circuit monitoring means further comprises electrical capacitive means for permitting the termination of spindle rotation to occur only upon a signal of predetermined strength being received, and to thereby prevent such termination upon an inadvertent electrical signal being received.

7. In a high speed textile spindle assembly as defined in claim 1 wherein said electric circuit monitoring means further comprises means for detecting whether the housing is electrically connected in said circuit monitoring means.

8. In a high speed textile spindle assembly as defined in claim 1 wherein said electric circuit monitoring means further includes means for generating said electric signal in the event no supply voltage is present in said circuit monitoring means.

* * * * *